US005370526A

United States Patent [19]

Buschulte et al.

[11] Patent Number: 5,370,526

[45] Date of Patent: Dec. 6, 1994

[54] BURNER POOR IN NITROGEN OXIDE

[75] Inventors: Winfried Buschulte, Neuenstadt; Erich Adis, Hardthausen; Manfred Bader, Neuenstadt, all of Germany

[73] Assignee: Deutsche Forschungsanstalt fuer Luft- und Raumfahrt e.V., Bonn, Germany

[21] Appl. No.: 142,361

[22] PCT Filed: Mar. 19, 1993

[86] PCT No.: PCT/EP93/00666

§ 371 Date: Jan. 19, 1994

§ 102(e) Date: Jan. 19, 1994

[87] PCT Pub. No.: WO93/19325

PCT Pub. Date: Sep. 30, 1993

[30] Foreign Application Priority Data

Mar. 21, 1992 [DE] Germany ..... 4209221

[51] Int. Cl.[5] ..... F23L 9/00

[52] U.S. Cl. ..... 431/116; 431/352

[58] Field of Search ..... 431/115, 116, 351, 352

[56] References Cited

U.S. PATENT DOCUMENTS 2,532,740 12/1950 Speer .
2,882,843 4/1959 Powell ..... 431/116
2,918,117 12/1959 Griffin ..... 431/116
3,869,246 3/1975 Hammond ..... 431/351
4,604,104 8/1986 Adis et al. ..... 431/116

FOREIGN PATENT DOCUMENTS 194079 9/1986 European Pat. Off. .
430011 11/1990 European Pat. Off. .
3906854 10/1990 Germany .

*Primary Examiner*—Carroll B. Dority
*Attorney, Agent, or Firm*—Barry R. Lipsitz

[57] ABSTRACT

In order to improve a burner for generating hot gas having a burner pipe, comprising a support pipe followed by a flame pipe, a nozzle arranged in the support pipe, a fuel jet exiting from the nozzle, a shield separating a precombustion chamber and a combustion chamber from one another in the burner pipe, the shield having a central passage penetrated by the fuel jet, recirculation openings arranged in the flame pipe and allowing an outer recirculation of cooled flue gas and an element for suppressing the outer recirculation during a starting phase of the burner, such that a reliable suppression of the outer recirculation during the starting phase is possible it is suggested that the element for suppressing the outer recirculation be arranged within the burner pipe and be controllable via a control means guided through an interior of the support pipe.

37 Claims, 6 Drawing Sheets

BURNER POOR IN NITROGEN OXIDE

The invention relates to a burner for generating hot gas having a burner pipe, comprising a support pipe followed by a flame pipe, a nozzle arranged in the support pipe, a fuel jet exiting from the nozzle, a shield separating a precombustion chamber and a combustion chamber from one another in the burner pipe, the shield having a central passage penetrated by the fuel jet, recirculation openings arranged in the flame pipe and allowing an outer recirculation of cooled flue gas and an element for suppressing the outer recirculation during a starting phase of the burner.

A suppression of the outer recirculation is necessary because during the starting procedure too much heat is withdrawn from the gasifying process of the fuel and the flame for heating the outer recirculation gases and so an interruption or extinguishing of the flame occurs.

Burners of this type are known from DE-PS 39 06 854. The disadvantage of these burners is to be seen in the fact that due to the heating up of the elements provided for the suppression of the outer recirculation during the starting phase, the functioning of these elements is impaired.

The object underlying the invention is therefore to improve a burner of the generic type such that a reliable suppression of the outer recirculation is possible during the starting phase.

This object is accomplished in accordance with the invention, in a burner of the type described at the outset, in that the element for suppressing the outer recirculation is arranged within the burner pipe and is controllable via a control means guided through an interior of the support pipe.

The advantage of the inventive solution is to be seen in the fact that with this solution the element for suppressing the outer recirculation is arranged within the burner pipe and, therefore, is already subjected to lower temperatures. In addition, due to the control means being guided through the support pipe these are exposed to the cooled combustion air flowing into the combustion chamber and are, therefore, likewise shielded from high temperatures so that, altogether, the problems known from the state of the art are avoided in the inventive solution.

The term suppression of the outer recirculation during the starting phase is to be understood as a suppression of the outer recirculation present in hot burners by more than 50%, preferably more than 70% and in particular cases more than 85%. A complete suppression of the outer recirculation represents an extreme case of the inventive teaching.

In a particularly advantageous variation of the inventive solution, the element for suppressing the outer recirculation is an element cutting off a flow of recirculation gas within the burner pipe in the form of a slide. The flow of recirculation gas in the burner pipe can be suppressed in a constructionally simple manner and also reliably with a slide-like element of this type.

In a solution which is, constructionally, particularly simple, the slide-like element is a slide having an annular casing and moving in axial direction. This is the simplest solution from a constructional point of view and, therefore, the most inexpensive to realize.

In this respect, it is particularly advantageous for the slide to have a sealing surface which is cylindrical relative to the axis. With this cylindrical sealing surface, the slide can be arranged in the burner pipe in a simple manner.

For constructional reasons it is also favorable for the slide to be guided on an inner side of the flame pipe so that no additional measures at all are required for the guidance of the slide.

The solution described in the above is one of the most simple solutions from a constructional point of view and therefore one of the most inexpensive. In a somewhat more complicated solution which is, however, functionally improved, the slide-like element has a sealing surface which is annular relative to the axis and located in a plane extending essentially at right angles to the axis. With this construction of the sealing surface, problems which occur in the case of a cylindrical sealing surface due to the individual parts being heated to varying extents can be avoided since the sealing surface extends at right angles to the direction of displacement of the slide and so all the varying tolerances which result are compensated by the displacement of the slide-like element. This means that the sealing quality, in particular, of a sealing surface arranged in this manner is considerably greater and can be achieved with extremely simple means.

In addition, it is particularly advantageous in this solution for the path of displacement of the slide-like element to be kept relatively small.

Moreover, this solution offers the advantage that an intermediate space, for example, between the flame pipe and the slide-like element can be kept sufficiently large so that there is no danger of the slide-like element and the adjusting mechanism provided herefor becoming jammed due to the parts heating up to varying extents.

Furthermore, the sealing surface extending at right angles to the axis prevents any oil which is possibly unburned from draining out of the burner pipe, which could lead to pollutant emissions.

In a particularly advantageous, constructional solution, the slide-like element is part of a sheath pipe extending within the support pipe.

The slide-like element is preferably a collar of the sheath pipe protruding beyond the shield in the direction of the combustion chamber.

In order to achieve a good seal in the plane extending at right angles to the axis, the collar of the sheath pipe can rest sealingly on an annular bead in the flame pipe. In this respect, the collar is preferably provided with an annular flange and the annular bead with a sealing element or they are designed as such.

With respect to the arrangement of the shield, no greater details have so far been given in this connection. It is, for example, particularly advantageous for the sheath pipe to bear the shield.

Alternatively to providing a collar, an additional solution provides for the slide-like element to be a section at the end face of the sheath pipe which is closed by the shield.

This section can expediently rest on an annular bead in the flame pipe.

Furthermore, it is favorable in this solution for the sheath pipe to bear the nozzle assembly, for example via a tripod.

In a particularly favorable and preferred embodiment, the sheath pipe is displaceable in axial direction in the burner pipe as a unit with the nozzle assembly and the shield.

In a further, advantageous development of the inventive solution, the slide-like element is a screening ring dividing a recirculation chamber into an inner and an outer recirculation chamber.

In this case, the slide-like element serves not only to suppress the flow of recirculation gas to the outer recirculation but also undertakes, at the same time, a separation of the recirculation chamber into an inner and an outer recirculation chamber.

In this case, the flow of recirculation gas can be stopped particularly simply when the screening ring can rest sealingly on the shield for suppressing the outer recirculation. This means that the screening ring is movable from a position, in which it is spaced from the shield and allows the outer recirculation, into a position abutting sealingly on the shield.

This means that two advantageous functions are combined in the screening ring and so a considerable improvement in the functioning of the burner can be achieved in a constructionally simple solution.

It is favorable in this respect for an annular sealing surface which is located outside a projection of a mixing tube onto the shield to be formed between the shield and the screening ring, i.e. for the sealing surface to be located outside the mixing tube.

In this case, it is also advantageous for the mixing tube not to be borne by the shield, as in the solutions described above, but rather for the screening ring to bear the mixing tube so that the mixing tube is moved simultaneously with the movement of the screening ring. This means that the mixing ratios created by the mixing tube in the mixing chamber can also be altered in a simple manner and simultaneously with the movement of the screening ring.

The displaceability of the screening ring may be realized in a particularly simple, constructional manner when the screening ring is displaceable by rods penetrating the shield. This solution is particularly advantageous within the scope of the present invention since it also ensures an adjusting mechanism for the screening ring which is located outside the hot parts of the burner. The adjusting mechanism is, on the contrary, cooled by the cold combustion air flowing into the combustion chamber.

In order to be able to guide and keep the rods and, also, the screening ring borne thereby aligned in axial direction in a simple manner, the rods are preferably guided for displacement in axial direction on the nozzle assembly non-displaceably arranged in the support pipe. The nozzle assembly therefore forms at the same time a guide for the alignment of the rods in the support pipe.

Within the scope of the embodiments described in the above, the outer recirculation has been suppressed by the slide-like element, i.e. the flow of recirculation gas has been cut off in the form of a slide.

An alternative and preferred embodiment of the inventive solution provides, in contrast to the embodiments described in the above, for the element for suppressing the outer recirculation to suppress any drawing in of cooled flue gas via the recirculation openings by opening a fresh-air supply. This means that no slide-like cut-off of the flow of recirculation gas takes place but that the drawing in of cooled flue gas is suppressed by a supply of fresh air into the recirculation chamber via means provided therefor so that the cooled flue gas sucked in during the warm operational state of the burner is replaced by the supply of fresh air and, therefore, the drawing in of the cooled flue gas is suppressed within the scope of the outer recirculation.

In an advantageous embodiment, this is realized by the element for suppressing the outer recirculation opening a fresh-air supply into the recirculation chamber, i.e. fresh air is supplied directly to the recirculation chamber, in which an underpressure prevails, so that cooled flue gas will be drawn into the recirculation chamber to a more limited degree.

This can be realized particularly expediently when a supply of fresh air from the precombustion chamber into the recirculation chamber can be generated with the element for suppressing the recirculation. With this solution, the supply of fresh air is realized very simply since fresh air is already available in the precombustion chamber adjacent the combustion chamber.

In this respect, it is preferable for a supply of fresh air into an outer recirculation chamber which is separated from an inner recirculation chamber to be generatable with the element for suppressing the outer recirculation. In this embodiment, the recirculation chamber is likewise separated in an advantageous manner into an outer and an inner recirculation chamber, in particular by means of a screening element, so that the outer recirculation can be selectively and concertedly suppressed by introducing fresh air into this outer recirculation chamber.

This may be realized in a particularly simple manner, from a constructional point of view, when the element opening the fresh-air supply into the recirculation chamber is arranged radially outwards from openings for the supply of combustion air from the precombustion chamber. This means that an additional possibility for generating a supply of fresh air during the starting phase is provided in the shield in addition to the openings for the supply of combustion air during all the operating states of the burner.

The supply of fresh air from the precombustion chamber may be realized particularly simply when this takes place via ventilation openings in the shield.

In order to be able to suppress this supply of fresh air again following the starting phase, the ventilation openings in the shield can be closed by a closure element. The closure element can be designed in the most varied of ways, for example as a slide or the like. It is favorable from a constructional point of view for the closure elements to be closure plugs which are movable in axial direction.

In order to keep the influence of differences in heating-up as low as possible, the closure elements are, in addition, arranged in the precombustion chamber since they are then exposed to the cold stream of fresh air and can be cooled by this.

In order to obtain a defined guidance of the closure elements, it is preferable for these to be guided for displacement in axial direction on the nozzle assembly held stationarily in the support pipe so that a defined alignment of the closure elements can be achieved in a simple manner.

Alternatively to the supply of fresh air directly into the recirculation chamber, as described in the above, the supply of fresh air in another, preferred embodiment of the inventive solution takes place in the vicinity of the recirculation opening.

This may be realized advantageously from a constructional point of view when the supply of fresh air can be generated in an annular intermediate space following the recirculation opening.

In this respect, it is preferable for the supply of fresh air to be controlled by a closure element arranged in the precombustion chamber. The supply of fresh air can then be realized in a constructionally favorable manner when a ventilation opening supplying fresh air from the precombustion chamber to the intermediate space can be opened or closed with the closure element.

A particularly simple solution is one, in which the ventilation openings can be closed with the closure element with a sealing surface which is cylindrical relative to the axis.

With respect to its functioning, it has proven particularly advantageous for the closure element to be guided on an inner side of the support pipe since this solution dispenses with an additional guidance of the closure element and, moreover, ensures a reliable functioning since the support pipe is not exposed to any high temperatures.

In conjunction with the explanations for the embodiments so far, nothing has been specified as to the extent to which the suppression is maintained during the starting phase.

In the simplest case, it would be conceivable to terminate the suppression of the outer recirculation in a single step following the starting phase. It is, however, even more advantageous to reduce the suppression of the outer recirculation successively following the starting phase or already towards the end thereof. In the simplest case, this can take place by way of a stepwise reduction, for example following defined periods of time. It is, however, particularly expedient for the reduction of the suppression to be continuous in order to ensure a continuous transition to the warm operational state without suppressing the outer recirculation.

Moreover, it is particularly advantageous in the present invention for the burner to have an inner recirculation since optimum combustion values can be achieved with the inner recirculation.

In addition, a solution has proven favorable, in particular to prevent any heating up of the nozzle assembly with the nozzle to high temperatures, in which in the warm operational state following the starting phase the outer recirculation enters an interior chamber of the burner located downstream of the nozzle through the recirculation openings so that the outer recirculation does not pass through either the nozzle assembly or the nozzle and heat these up inappropriately.

With respect to favorable maintenance, the best embodiment of the inventive solution has proven to be one, in which a stationary alignment of nozzles, shield and mixing tube in combination with predetermined inner and outer recirculations is determined so that no disadjustment of any kind of the burner properties is possible and the inventive suppression of the outer recirculation and the later release in the warm operating state is possible only in the starting phase.

Additional features and advantages are the subject matter of the following description as well as the drawings of several embodiments. In the drawings.

The invention relates to the most varied types of oil or gas burners and will be explained in the following with the example of a so-called blue burner, i.e. a burner, in which oil is completely burned with a blue flame. The invention is not, however, limited to such blue burners. The inventive effects can be achieved with the constructional measures described in warming-up burners and yellow burners, as well.

Figure 1:
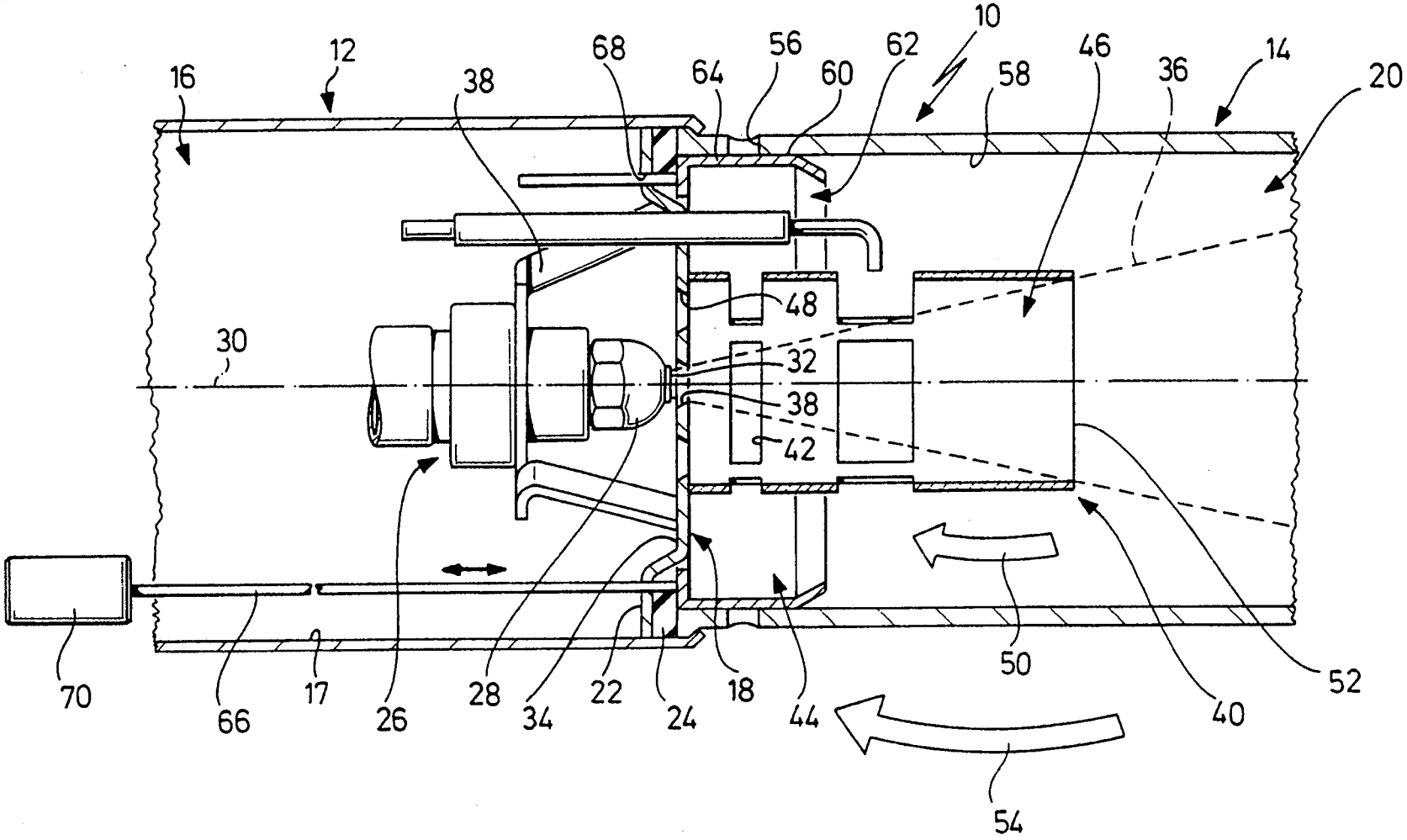
FIG. 1 is a longitudinal section through a first embodiment of an inventive burner.

A first embodiment of an inventive burner, illustrated in FIG. 1, comprises a burner pipe designated as a whole as 10, which has a support pipe 12 mounted on a burner frame which is not illustrated in the drawing. This support pipe 12 also bears a flame pipe 14 comprised by the burner pipe 10, whereby the support pipe 12 and the flame pipe 14 are, for example, connected with one another by folding.

A precombustion chamber designated as whole as 16 is arranged in the support pipe 12 and extends as far as a shield 18 which forms a dividing wall between the precombustion chamber 16 and a combustion chamber 20 which is essentially arranged in the flame pipe 14. The shield 18 is held in the center of the support pipe 12 and arranged at the transition from the support pipe 12 to the flame pipe 14. The shield 18 is supported, on the one hand, on an inner side 17 of the support pipe 12 with an outer annular flange 22 and abuts, on the other hand, on an insulating ring 24 with its side facing the flame pipe 14. This insulating ring provides a thermal insulation for insulating against infiltrated air between the flame pipe 14 and the annular flange 22.

A nozzle assembly designated as a whole as 26 and having a nozzle 28 is also arranged in the precombustion chamber 16, this nozzle 28 being preferably aligned coaxially to a central axis 30 of the burner pipe 10.

The nozzle 28 has an outlet 32 which is arranged in the direction of the central axis 30 at a slight distance upstream of a surface 34 of the shield 18 facing the precombustion chamber 16.

A fuel jet 36 exits from this outlet 32, penetrates a central passage 38 in the shield 18 and expands in the combustion chamber 20 within the flame pipe 14 downstream of the shield 18.

The nozzle assembly 26 is preferably held with a support 38 on the shield 18 and this is preferably guided in the support pipe 12.

A mixing tube designated as a whole as 40 adjoins the shield 18 within the combustion chamber 20 and is provided with circumferential openings 42 following the shield 18. A recirculation of flue gas from a recirculation chamber 44 which is located within the flame pipe 14 and outside the mixing tube 40 into a mixing chamber 46 located within the mixing tube 40 takes place through these openings, this mixing chamber likewise being penetrated by the fuel jet 36.

Combustion air from the precombustion chamber 16 is also supplied to the mixing chamber 46 via openings 48 in the shield 18 arranged around the passage 38. These openings 48 are preferably bevelled on their side facing the precombustion chamber 16 and therefore contribute to reducing the noise of the burner.

While the inventive burner is in operation, an inner recirculation 50, which starts at one end 52 of the mixing tube facing away from the shield 18 and flows back to the circumferential openings 42, takes place, on the one hand, into the recirculation chamber 44, along with an outer recirculation 54, in which cooled flue gases flow around in the boiler room on an outer side of the flame pipe 14 and pass through recirculation openings 56 which are preferably arranged in the periphery of the flame pipe 14 near to its end facing the support pipe.

A reduction in the combustion temperature and, therefore, a reduction of the proportion of nitrogen oxide in the burner can be achieved due to this outer recirculation 54.

For suppressing the outer recirculation 54 through the recirculation openings 56, a slide 62 is arranged in the interior of the flame pipe 14. This slide engages on the inner side 58 of the flame pipe with a cylindrical outer side 60, is designed as a cylindrical ring and is displaceable in the direction of the central axis 30 within the flame pipe 14 such that the recirculation openings 56 are either closed or released. The annular slide 62 is guided merely by its outer side 60 on the inner side 58 of the flame pipe and displaced in the direction of the shield 18 for closing the recirculation openings so that its casing 64 rests on the inner side 58 of the flame pipe 14 in front of the recirculation openings 56 and closes them. For opening the recirculation openings 56 the slide 62 is displaced away from the shield 18 so that the casing 64 releases the recirculation openings.

A rod-linkage means 66 is provided as control means for actuating the slide 62. This rod-linkage means is guided through an opening 68 of the shield 18 and extends within the support pipe 12 through the precombustion chamber 16, in particular a region of the precombustion chamber 16 cooled by the combustion air flowing to the combustion chamber 20, as far as an actuating member 70 which is, for example, a hydraulic or pneumatic cylinder or another linear displacement unit.

During the starting phase of the burner, the slide 62 with its casing 64 can be moved in front of the recirculation openings 56 and thereby suppresses the outer recirculation 54 into the mixing chamber 46 so that the burner burns in a stable manner in the starting phase. Once the starting phase has terminated, the slide 62 is displaced in the direction away from the shield 18 via the actuating member 70 and the rod-linkage means 66, and to such an extent until the casing 64 releases the recirculation openings 56. In this case, the burner burns again with outer recirculation and, therefore, a reduced proportion of nitrogen oxide.

Figure 2:
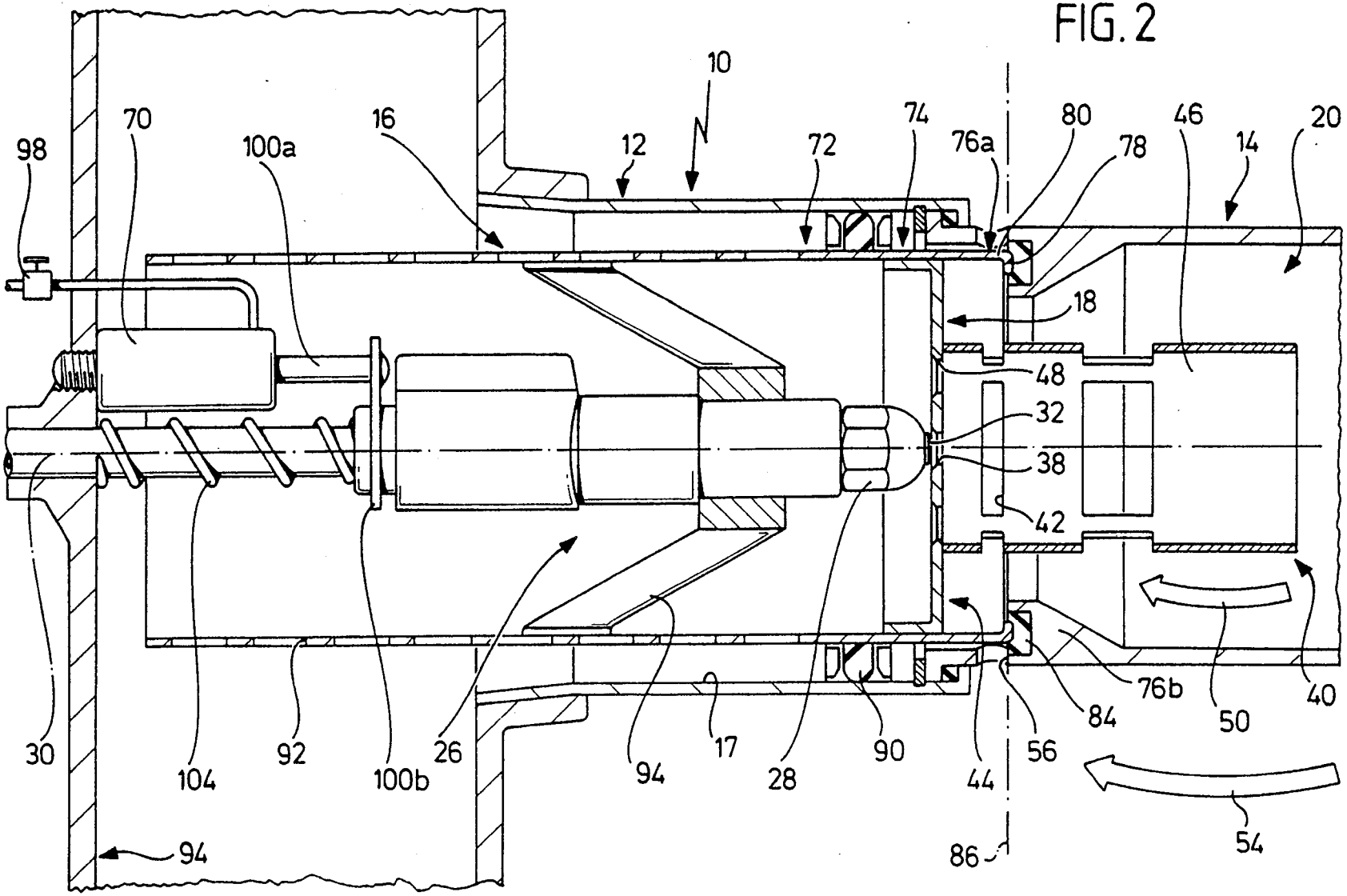
FIG. 2 is a longitudinal section through a second embodiment of an inventive burner.

A second embodiment, illustrated in FIG. 2, has been given the same reference numerals insofar as this has parts identical to the first embodiment and so, in this respect, reference is made to the comments on the first embodiment in their entirety.

In contrast to the first embodiment, the shield 18 of the second embodiment illustrated in FIG. 2 is held on a sheath pipe 72 which extends coaxially to and within the support pipe 12. The sheath pipe 72 has a front section 74 which is closed on the side of the casing. This front section bears, on the one hand, the shield 18 but, on the other hand, extends beyond this shield and forms a collar **76*a* projecting beyond the shield 18 in the direction of the combustion chamber 20. An annular flange 78 is integrally formed on this collar at its front end facing away from the shield 18 in order to collect dripping oil during the starting procedure and subsequently allow this to vaporize. In the same way as in the first embodiment, the shield 18 bears the mixing tube 40** which is also designed in an identical manner to the first embodiment.

In addition, the recirculation openings 56 are provided in the flame pipe 14 directly following the support pipe 12.

For suppressing the outer recirculation 54, the collar **76*a* extends from the shield 18 into the combustion chamber 20 to such an extent that it is positionable with its outer surface 80 within the flame pipe 14 in front of the recirculation openings 56**.

For sealing the recirculation openings 56, the flame pipe 14 is provided with an annular bead **76*b* protruding from the inner side 58 of the flame pipe. A sealing ring 84 is inserted into this bead on its side facing the shield 18, whereby the annular bead 76*b* is arranged with the sealing ring 84 on a side of the recirculation openings 56** located opposite the shield.

The sealing ring 84 has such a radius that the annular flange 78 of the collar **76*a* can rest against it and, therefore, a sealing surface lying in a plane 86 at right angles to the central axis 30 is created between the sealing ring 84 and the annular flange 78 and is likewise located on the side of the recirculation openings 56 opposite the shield 18**.

The outer recirculation 54 can therefore be completely suppressed by the annular flange 78 resting on the sealing ring 84. In accordance with the invention it is, however, sufficient for suppressing the outer recirculation 54 not to provide a complete seal between the collar **76*a* and the annular bead 76*b* and so the sealing ring 84** is not absolutely necessary.

If, on the other hand, the sheath pipe 72 is moved away from the combustion chamber 20 in the direction of the central axis 30, the annular flange 78 lifts away from the sealing ring 84 and can be withdrawn to such an extent that the annular flange 78 is located on the side of the recirculation openings 56 facing the shield 18 and, therefore, the recirculation openings 56 again allow the outer recirculation 54 into the recirculation chamber 44.

The outer surface 80 preferably does not abut on either the inner side 58 of the flame tube 14 or on an inner side of the support tube 12 but extends at a distance relative to them. A seal relative to the inner side 17 of the support pipe 12 results from an annular seal 90 which is located between this inner side and the outer surface 80 and is preferably secured to the closed section 74 of the sheath pipe 72.

For suppressing the outer recirculation a seal results, on the one hand, in the plane 86 between the annular flange 78 and the sealing ring 84 and, on the other hand, between the outer surface 80 and the inner side 88 of the support pipe 12 by means of the annular seal 90.

The sheath pipe 72 extends, in addition, still further into the precombustion chamber 16 but is perforated in this region by a plurality of openings 92 so that the combustion air flowing into the combustion chamber 20 can pass through the sheath pipe.

The nozzle assembly 26 is arranged in the sheath pipe 62 and is displaceable therewith. The nozzle assembly is supported on the sheath pipe 72 via a holding arm 94 forming a tripod.

For displacing the sheath pipe 72, the actuating member 70 is arranged on a side on the burner support 94 opposite the shield 18 and is, for example, a hydraulic cylinder which can be actuated by the pressure of the oil conveyed to the nozzle 28, whereby this pressure can be switched on or off for the hydraulic cylinder 70 by means of a valve 98.

In this embodiment, a piston rod **100*a* of the hydraulic cylinder 70 engages on the nozzle assembly 26 via a holder 100***b* and displaces the nozzle assembly with the sheath pipe 72 in the direction of the central axis 30, either in the direction of the combustion chamber 20 or in the opposite direction. In this respect, a spring 104 is preferably provided which acts on the nozzle assembly 26 in the direction of the combustion chamber 20 so that without any action of the actuating member 70 the sheath pipe 72 is also displaced in the direction of the combustion chamber and abuts with its annular flange 78 on the sealing ring 84 within the flame pipe.

By switching the valve 98 and, therefore, actuating the hydraulic cylinder 70, the nozzle assembly is withdrawn in the direction away from the combustion chamber 20 and so the recirculation openings 56 are released, as already described, following the starting phase.

The advantage of the second embodiment is to be seen in the fact that, firstly, a seal results within the flame pipe 14 and, secondly, by a movement in the direction of the central axis 30 so that the plane 86, in which the seal results, is at right angles to the central axis 30.

This will avoid, in particular, all the problems which can result due to differing thermal expansion in the flame pipe 14 and in the sheath pipe 72. Moreover, a sufficiently large space can be maintained between the flame pipe 14 and the sheath pipe 72 to avoid problems for the seal for suppressing the outer recirculation 54 due to considerable heating up.

In addition, it is particularly advantageous for the recirculation openings 56 to be dimensioned such that their slot width is smaller but, on the other hand, their circumferential extension is greater so that a more uniform distribution of the cooled flue gases from the outer recirculation 54 results and, moreover, only a small adjustment path for the displacement of the sheath pipe 72 is necessary for suppressing the outer recirculation 54.

Furthermore, all the elements for suppressing the recirculation, i.e. the collar 76*a* with the annular flange 78 as well as the annular bead 76*b* with the sealing ring 84 as well as the annular seal 90, are located according to the invention within the combustion chamber 10 and, in the same manner, the control means 100*a*, 100*b* for actuating the sheath pipe 72 for suppressing the outer recirculation 54 are also arranged within the burner pipe 10, namely in the support pipe 12, in particular in a region which has cold combustion air for the combustion chamber 20 flowing through it.

Figure 3:
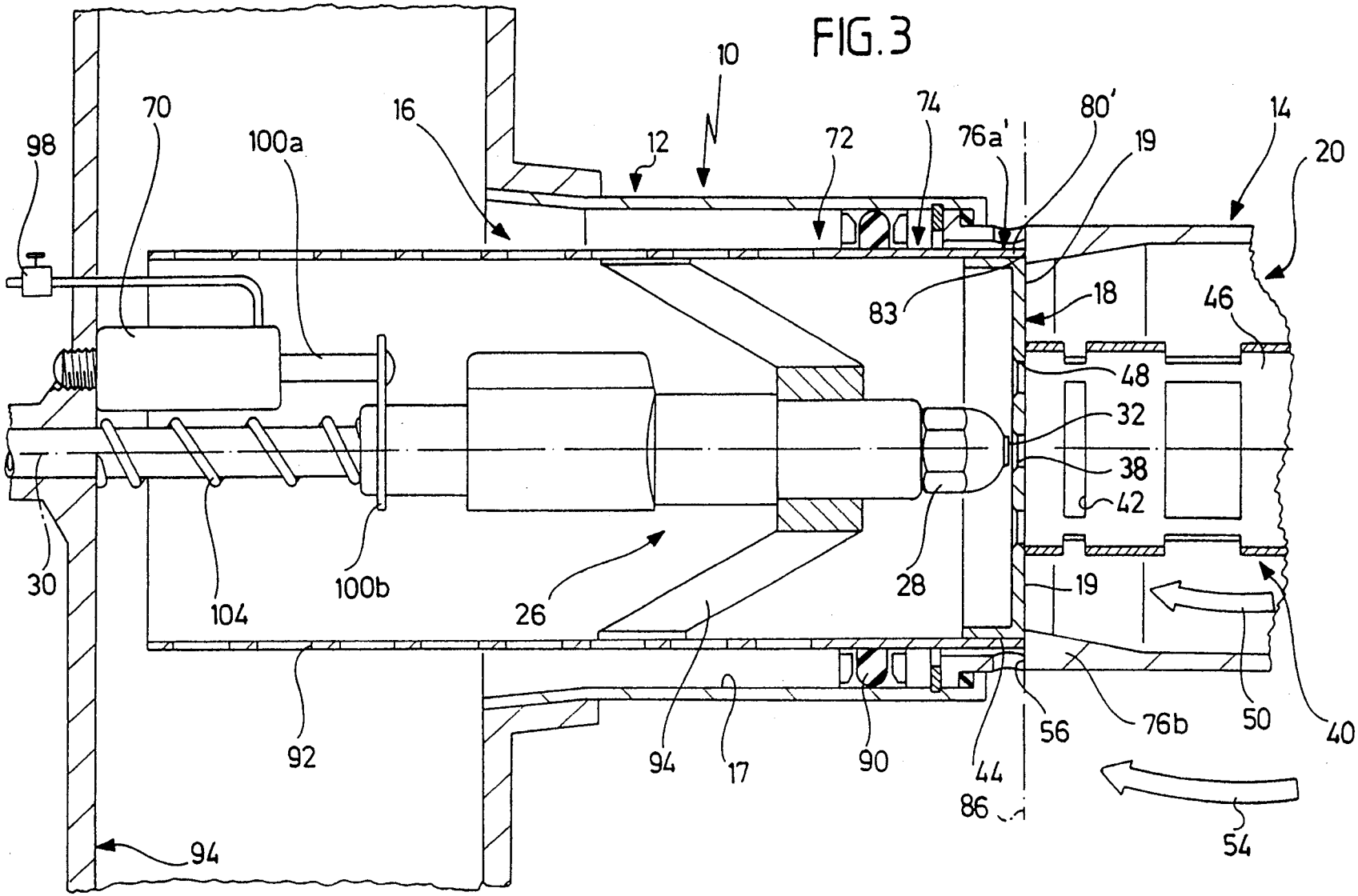
FIG. 3 is a longitudinal section through a third embodiment of an inventive burner.

A third embodiment illustrated in FIG. 3 is constructed in a similar manner to the second embodiment. However, the third embodiment differs from the second embodiment in that the sheath pipe 72 is not provided with a collar 76*a* but extends as far as an end face of the shield 18 but not beyond this.

An end section 76*a*′ of the sheath pipe 72 takes over the function of the collar 76*a* and is displaceable together with the sheath pipe 72 to such an extent in the direction of the combustion chamber that it is positionable with its front end surface 80′ within the flame pipe 14 in front of the recirculation openings 56 in order to suppress the outer recirculation 54.

To seal the recirculation openings 56, the flame pipe is provided in the same way as in the second embodiment with the annular bead 76*b* which protrudes from the inner side 58 but does not have a sealing ring 84 but merely an end contact surface 83 which faces the end face 90 of the shield and is arranged downstream of the recirculation openings 56.

The contact surface 83 has such a radial extension that the end section 76*a*′ of the sheath pipe 72 can abut on this surface, in particular with the end face 19 of the shield 18, so that an essentially tight seal can be achieved between the end contact surface 83 and the end face 90 with a sealing surface located in the plane 86 at right angles to the central axis 30. In this respect, the plane 86 is located downstream of the recirculation openings 56 and, in addition, the annular seal 90 ensures a seal between the sheath pipe 72 and the support pipe 12.

In the third embodiment, the outer recirculation 54 is already adequately suppressed for the starting phase of the burner when the recirculation is essentially, i.e. to more than 50% or, in particular, more than 70%, suppressed so that it is sufficient for the end section 76*a*′, with the end face 90, to be at a slight distance from the end contact face 83, whereby this can be in the order of one millimeter. The remaining gap does allow a slight recirculation but does not lead to the disturbances during the starting phase described at the outset.

Moreover, it is advantageous in the third embodiment for the hydraulic cylinder 70, in the starting phase, to displace the sheath pipe 72 with the end section 76*a*′ first of all to such an extent in the direction of the annular bead 76*b* that the outer recirculation is suppressed. Following the starting of the burner it then moves the end section 76*a*′ away from the annular bead 76*b* successively in a plurality of steps in accordance with defined periods of time so that the suppression of the outer recirculation 54 is gradually reduced until the full recirculation 54 is allowed through the recirculation openings 56 once the starting phase has terminated.

Such an actuation of the hydraulic cylinder 70 preferably results by the hydraulic cylinder being acted upon in a dosed manner, by means of the valve 98, with the pressure of the fuel supplied to the nozzle 28.

Figure 4:
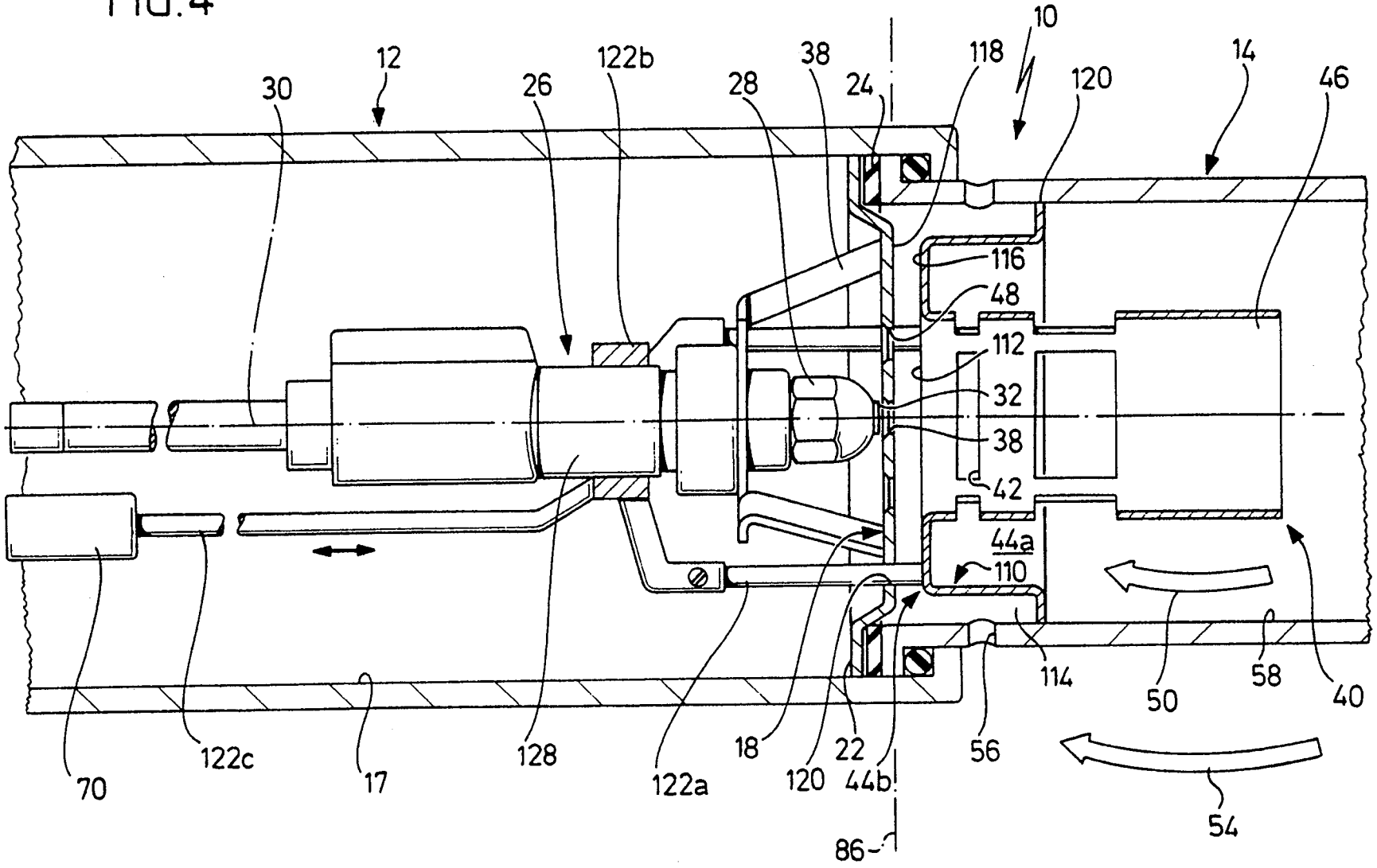
FIG. 4 is a longitudinal section through a fourth embodiment of an inventive burner.

In a fourth embodiment of the inventive solution, illustrated in FIG. 4, those parts which are identical to those of the first and second embodiments have also been given the same reference numerals and so, in this respect, reference can be made to the comments on the preceding embodiments, in particular the first embodiment.

In the fourth embodiment, the burner pipe 10 is also formed from the support pipe 12 and the flame pipe 14 and, in addition, the shield 18 is held stationarily centered in the support pipe 12, whereby its annular flange 22 reaches as far as the inner side 17 of the support pipe 12. The shield 18 abuts with the annular flange 22 on the insulating ring 24 and is therefore insulated thermally and against infiltrated air relative to the flame pipe 14 and the support pipe 12 by this insulating ring.

The recirculation openings 56 are arranged in the flame pipe 14 in the same way as in the first embodiment.

In addition, the nozzle assembly 26 is connected with the shield 18 via the support 38 in the same way as in the first embodiment.

In contrast to the first embodiment, the shield 18 does not bear the mixing tube 40 but the mixing tube 40 is held, for its part, by a screening ring 110 which extends in radial direction outwards to the inner side 58 of the flame pipe starting from an end face 112 of the mixing tube 40 facing the shield 18. It forms an annular chamber 114 between itself and the inner side 58, in which the recirculation openings 56 open irrespective of the position of the screening ring 110. Furthermore, the screening ring 110 forms a surface 116 which faces the shield 18 and extends parallel to a surface 118 of the shield 18 facing the combustion chamber 20. The surface 118 and the surface 116 preferably extend parallel to the plane 86' at right angles to the central axis 30. In addition, the screening ring 110, with its outer edge 120, abuts essentially sealingly on the inner side 58 and therefore constantly separates the recirculation chamber 44, namely into a recirculation chamber **44*a*, into which the inner recirculation 50 leads, and a recirculation chamber 44*b*, into which the outer recirculation 54 leads through the recirculation openings 56. The outer recirculation chamber 54 therefore supplies the mixing tube 40 with cooled flue gas via its end face 112 facing the shield 18 while the inner recirculation chamber supplies the mixing tube 40 with hot flue gas via the circumferential openings 42**.

The screening ring 110 may be moved in accordance with the inventive solution such that its surface 116 abuts on the surface 118 of the shield 18 and therefore separates the outer recirculation chamber **44*b* from the mixing chamber 46 so that the outer recirculation 54 is suppressed. On the other hand, the screening ring 110 can be moved in the direction of the combustion chamber 20 to such an extent that a channel leading from the annular chamber 114 into the mixing chamber 46 is formed between the surface 118 and the surface 116 of the screening ring 110 so that the outer recirculation 54** can take place.

A rod-linkage means 122 is provided for moving the screening ring 110 with its surface 116 essentially parallel to the surface 118. This rod-linkage means has rods **122*a* proceeding from a guide ring 122*b* guided on the nozzle assembly 26 and each penetrating through openings 120 in the shield. This guide ring is, for its part, again connected to the actuating member 70 via a rod-linkage means 122*c***.

The parallel guidance of the surface 116 relative to the surface 118 is brought about by the guide ring **122*b* which is mounted for sliding displacement on a cylinder surface 128 of the nozzle assembly 26**.

The advantage of this solution is to be seen in the fact that due to the separation of the recirculation chambers **44*a* and 44*b*, the inner recirculation 50 and the outer recirculation 54** can be adjusted in accordance with optimum operating conditions.

Figure 5:
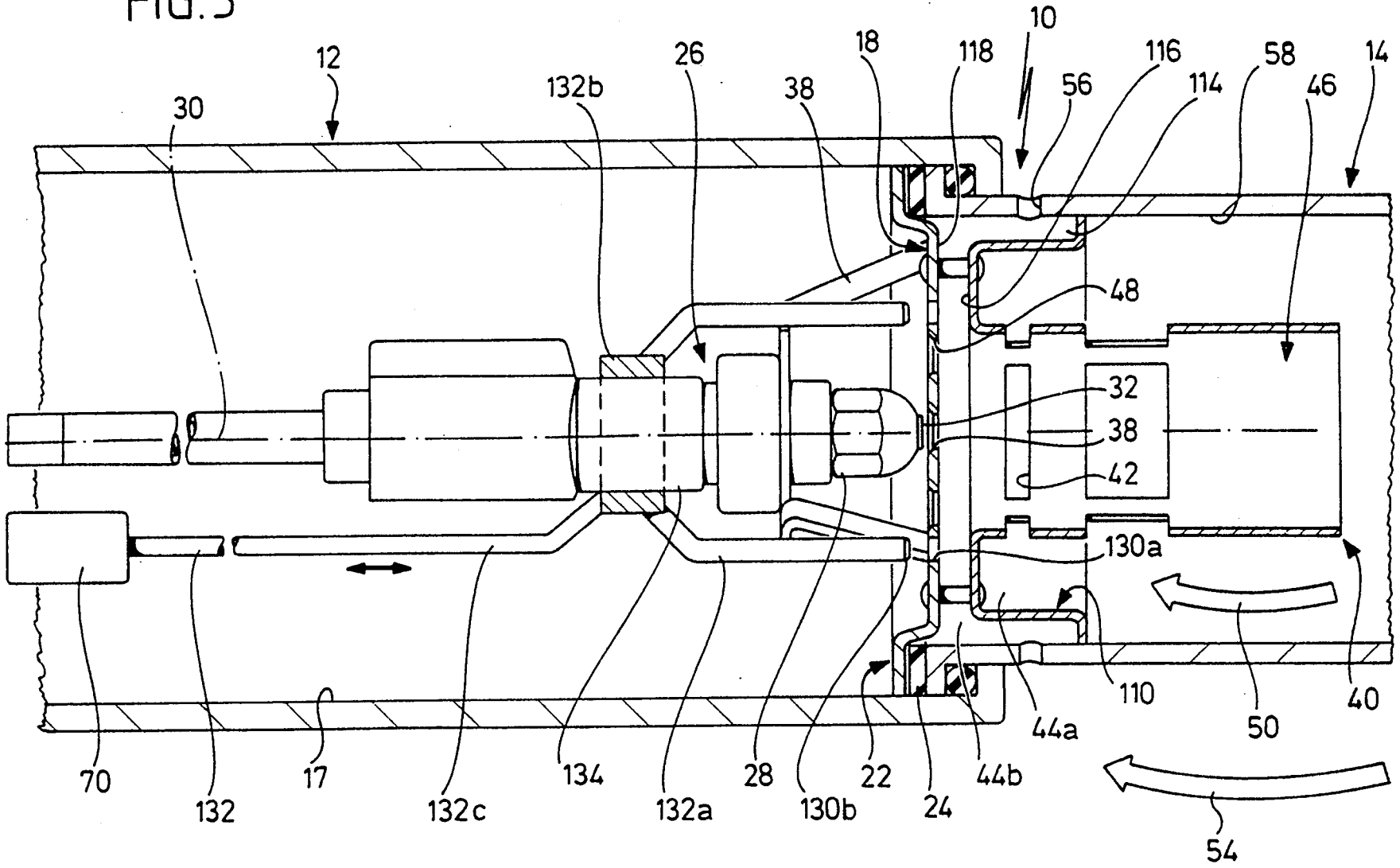
FIG. 5 is a longitudinal section through a fifth embodiment of an inventive burner and FIG. 6 is a longitudinal section through a sixth embodiment of an inventive burner.

In a fifth embodiment, illustrated in FIG. 5, those parts which are identical to those described in the above, in particular to the first and third embodiments, have been given the same reference numerals and so reference can be made to the comments thereon.

In the same way as in the third embodiment, the fourth embodiment also has a screening ring 110 which is, however, fixed in position with the surface 116 at a constant distance from the surface 118 of the shield 18. The screening ring 110 therefore separates the outer recirculation 54 through the recirculation openings 56 from the inner recirculation 50. The screening ring 110 therefore acts as a divider between the outer recirculation 54 and the inner recirculation 50 but is not displaceable for the purpose of suppressing the outer recirculation 54.

Ventilation openings **130*a* are provided radially outwards from the openings 48 for suppressing the outer recirculation. These openings are, in relation to the axis 30, located radially outside a projection of the mixing tube 40 onto the shield 18. These ventilation openings 130*a* can be closed by closure elements 130*b*, whereby the closure elements 130*b* are, in the simplest case, closure plugs which can be inserted into the ventilation openings 130*b* parallel to the direction of the axis 30 in order to close these openings. These closure plugs are seated on rods 132*a* which, for their part, are guided with a guide ring 132*b* on the nozzle assembly 26 so as to be displaceable in the direction of the axis 30 on a cylinder surface 134. The guide ring 132*b* is, for its part, again displaceable by a rod-linkage means 132*c* which is connected to the actuating member 70**.

If the closure plugs **130*b* are moved away from the shield 18 in the direction of the axis 30 and the ventilation openings 130*a* thus opened, these lead in the outer recirculation chamber 44*b* to a reduction in the underpressure necessary for drawing in the cooled flue gases through the recirculation openings 56 and therefore suppress the outer recirculation. At the same time, fresh air is supplied through the ventilation openings 130*a* to the outer recirculation chamber 44*b* and this fresh air passes from this outer recirculation chamber 44*b* into the mixing tube 40 and therefore contributes to an additional supply of oxygen for the fuel jet 36. Therefore, the ventilation openings 130*a* as well as the closure plugs 130*b* are already shielded to a great extent by the screening ring 110 from the high temperatures in the combustion chamber 20 so that in the region thereof, in particular when the ventilation openings 130*a* are closed by means of the closure plugs 130*b***, no problems occur due to uneven heating.

During the starting phase, the ventilation openings **130*a* are opened so that the outer recirculation 54 is suppressed. Subsequently, the ventilation openings 130*a* are closed by means of the closure plugs 130*b* by moving the rod-linkage means 132*c* with the guide ring 132*b* and the rods 132*a* in the direction of the shield 18 so that the customary underpressure, which is necessary for starting the outer recirculation 54 through the recirculation openings 56, builds up again in the outer recirculation chamber 44*b***.

Figure 6:
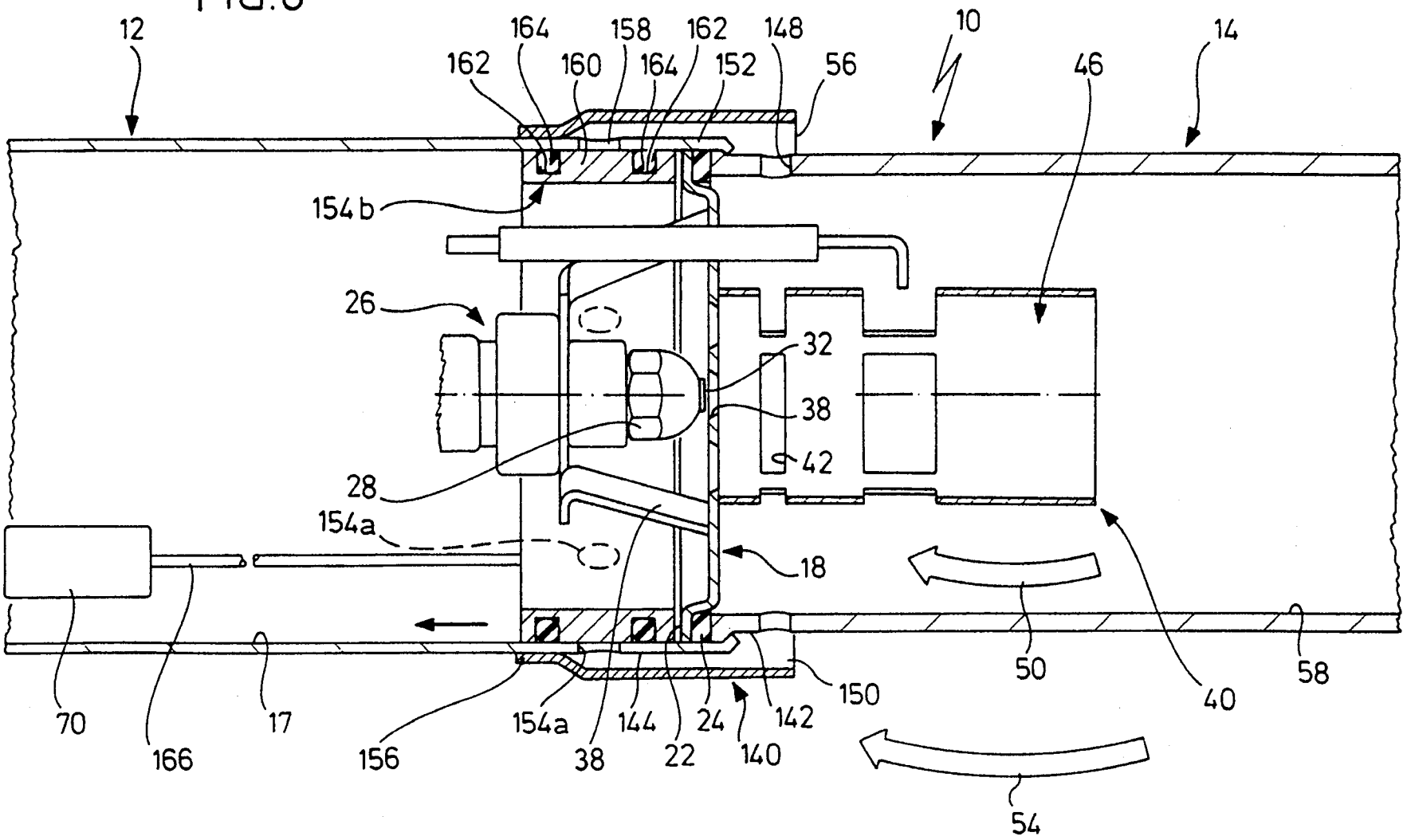

In a sixth embodiment, illustrated in FIG. 6, those parts which are identical to those of the preceding embodiments have been given the same reference numerals. With respect to their description, reference is made to the comments on the preceding embodiments, in particular the first embodiment.

In the fifth embodiment, inlet openings 148 are provided in the flame pipe 14 but these are not the actual recirculation openings. A sleeve 140 of the burner pipe 10, which extends in relation to the axis 30 at a radial distance from an outer wall 142 of the flame pipe and an outer wall 144 of the support pipe, engages over the inlet openings 148 on the outer side of the flame pipe 14. The sleeve 140 extends beyond the inlet openings 148 in the direction of a downstream end of the flame pipe 14 and ends with the recirculation opening 56 for the cooled flue gas from the boiler room used for the outer recirculation 54. This means that during the warm operating state and outside the starting phase, this flue gas flows first of all via the recirculation opening 56 into an intermediate space 150 between the sleeve 140 and the outer side 142 of the flame pipe 14 and enters the recirculation chamber 44 from this intermediate space 150 via the inlet openings 148.

The sleeve 140 also extends—as already mentioned—over a front section 152 of the support pipe 12 and engages over ventilation openings **154*a* which connect the intermediate space 150 with the precombustion chamber 16. Following the ventilation openings 154***a*, the sleeve 140 abuts on the outer side 144 of the support pipe 12 with a flange 156 and is preferably held by the support pipe 12 via this flange 156 so that the intermediate space 150 is merely accessible from the boiler room via the recirculation opening 56.

The ventilation openings 154*a* can be closed by a slide 154*b* which is arranged in the interior of the support pipe 12 and guided with an outer surface 158 on the inner side 17 of the support pipe 12. This slide 154*b* comprises an annular casing 160 which bears the outer surface 158 and into which two grooves 162 are worked at a distance from one another in the direction of the axis 30. The sealing rings 164 are located in these grooves. The sealing rings are hereby spaced from one another such that when the outer side 158 of the slide 154*b* is in front of the ventilation openings 154*a* and closes these, they provide for a seal on both sides of the ventilation openings 154*a* between the slide 154*b* and the inner side 17 of the support pipe 12.

If the slide 154*b* is in its position closing the ventilation openings 154*a*, a customary outer recirculation 54 takes place, whereby the cooled flue gases flow via the inlet opening 148 and the recirculation openings 56 in the flame pipe into the recirculation chamber 44.

If, on the other hand, the slide 154*b* is moved in the direction away from the shield 18 so that this releases the ventilation openings 154*a*, fresh air can flow into the intermediate space 150 from the precombustion chamber 16 through the ventilation openings 154*a* and therefore suppresses any flowing in of cold flue gases via the recirculation opening 56. This means that it is no longer cold flue gases which flow into the recirculation chamber 44 through the inlet openings 148 but essentially fresh air. The outer recirculation 54 is therefore suppressed during the starting phase of the burner and, in addition, the mixing chamber 46 is supplied with fresh air rich in oxygen via the circumferential openings 42.

A rod-linkage means 166 is guided through the precombustion chamber 16 for actuating the slide 154*b* in the same manner as, for example, in the first embodiment and this rod-linkage means is connected to the actuating member 70.

We claim:

1. A burner for generating hot gas, having a burner pipe comprising a support pipe followed by a flame pipe, a nozzle arranged in the support pipe, a fuel jet exiting from said nozzle, a shield separating a precombustion chamber and a combustion chamber from one another in the burner pipe, said shield having a central passage penetrated by the fuel jet, recirculation openings arranged in the flame pipe and allowing an outer recirculation of cooled flue gas, and means including an element for suppressing the outer recirculation during a starting phase of the burner, said element for suppressing the outer recirculation being arranged within the burner pipe and being controllable via a control means guided through an interior of the support pipe.

2. A burner as defined in claim 1, characterized in that the element for suppressing the outer recirculation is an element cutting off a flow of recirculation gas within the burner pipe in the form of a slide.

3. A burner as defined in claim 2, characterized in that the slide-like element is a slide having an annular casing and movable in an axial direction along an axis.

4. A burner as defined in claim 3, characterized in that the slide has a sealing surface cylindrical relative to the axis.

5. A burner as defined in claim 3, characterized in that the slide is guided on an inner side of the flame pipe.

6. A burner as defined in claim 3, characterized in that the slide-like element has a sealing surface annular relative to the axis and located in a plane extending essentially at right angles to the axis.

7. A burner as defined in claim 2, characterized in that the slide-like element is part of a sheath pipe extending within the support pipe.

8. A burner as defined in claim 7, characterized in that the slide-like element is a collar of the sheath pipe protruding beyond the shield in the direction of the combustion chamber.

9. A burner as defined in claim 8, characterized in that the collar of the sheath pipe is adapted to abut on an annular bead in the flame pipe.

10. A burner as defined in claim 7, characterized in that the sheath pipe bears the shield.

11. A burner as defined in claim 9, characterized in that the slide-like element is an end section at the end face of the sheath pipe closed by the shield.

12. A burner as defined in claim 11, characterized in that the sheath pipe is adapted to abut with the end section on an annular bead in the flame pipe.

13. A burner as defined in claim 7, characterized in that the sheath pipe bears the nozzle assembly.

14. A burner as defined in claim 10, characterized in that the sheath pipe is displaceable in an axial direction as a unit with the nozzle assembly and the shield.

15. A burner as defined in claim 2, characterized in that the slide-like element is a screening ring dividing a recirculation chamber into an inner and an outer recirculation chamber.

16. A burner as defined in claim 15, characterized in that the screening ring is adapted to abut sealingly on the shield for suppressing the outer recirculation.

17. A burner as defined in claim 15, characterized in that an annular sealing surface located outside a projection of a mixing tube onto the shield is formed between the shield and the screening ring.

18. A burner as defined in claim 17, characterized in that the screening ring bears the mixing tube.

19. A burner as defined in claim 15, characterized in that the screening ring is displaceable by rods penetrating the shield.

20. A burner as defined in claim 19, characterized in that the rods are guided for displacement in an axial direction on the nozzle assembly non-displaceably arranged in the support pipe.

21. A burner as defined in claim 1, characterized in that an actuating device acting on the control means is provided for successively reducing the suppression of the outer recirculation following the starting phase.

22. A burner as defined in claim 1, characterized in that in a warm operating state following the starting phase, the outer recirculation enters an interior chamber of the burner located downstream of the nozzle through the recirculation openings.

23. A burner as defined in claim 1, comprising a fresh air supply means including an opening and wherein said element for suppressing the outer recirculation is adapted to open and close said opening to control a fresh air supply to suppress the drawing in of cooled flue gas via the recirculation openings.

24. A burner as defined in claim 23 further comprising means forming a recirculation chamber within said burner pipe, said recirculation chamber receiving fresh air from said fresh air supply means when the drawing in of cooled flue gas via said recirculation openings is suppressed.

25. A burner as defined in claim 24 wherein said fresh air is supplied from said precombustion chamber.

26. A burner as defined in claim 24 wherein said recirculation chamber is an outer recirculation chamber separated from an inner recirculation chamber, said outer recirculation chamber being adapted to receive fresh air from said fresh air supply means when the drawing in of cooled flue gas via said recirculation openings is suppressed.

27. A burner as defined in claim 24 wherein said shield has first openings for supplying said combustion chamber with combustion air from said precombustion chamber and second openings arranged radially outwardly from said first openings for supplying said fresh air to said recirculation chamber.

28. A burner as defined in claim 23 wherein said shield includes ventilation openings for passing fresh air from said fresh air supply into said combustion chamber from said precombustion chamber.

29. A burner as defined in claim 28 wherein said element includes closure plugs that are movable in an axial direction toward said shield to close said ventilation openings.

30. A burner as defined in claim 29 wherein said closure plugs reside in said precombustion chamber.

31. A burner as defined in claim 28 wherein said nozzle is stationarily mounted along a longitudinal axis in said support pipe and said element includes closure elements mounted in said support pipe for axial displacement along said axis toward said shield to close said ventilation openings.

32. A burner as defined in claim 23 wherein fresh air from said fresh air supply means is provided adjacent said recirculation openings.

33. A burner as defined in claim 32 further including means forming an annular intermediate space adjacent said recirculation openings for receiving said fresh air.

34. A burner as defined in claim 33 wherein said closure element is adapted to open and close a ventilation opening between said precombustion chamber and said intermediate space to selectively supply fresh air from the precombustion chamber to said intermediate space.

35. A burner as defined in claim 34 wherein said closure element comprises a cylindrical sealing surface that is coaxial with a longitudinal axis of said burner pipe.

36. A burner as defined in claim 35 further comprising means for guiding said closure element along an inner wall of said support pipe.

37. A burner as defined in claim 1 further comprising a mixing tube mounted in said flame pipe and having inner recirculation openings for recirculation of said hot gas within said combustion chamber.

* * * * *